US005757262A

United States Patent [19]

Takeda

[11] Patent Number: 5,757,262

[45] Date of Patent: May 26, 1998

[54] THERMOSTAT WITH BULGING PORTION TO PREVENT CONTACT OF A RESILIENT PLATE TO HOUSING

[75] Inventor: Hideaki Takeda, Misato, Japan

[73] Assignee: Uchiya Thermostat Co., Misato, Japan

[21] Appl. No.: 566,010

[22] Filed: Dec. 1, 1995

[30] Foreign Application Priority Data

Dec. 9, 1994 [JP] Japan ..... 6-305811

[51] Int. Cl.[6] ..... H01H 37/04

[52] U.S. Cl. ..... 337/380; 337/333; 337/372

[58] Field of Search ..... 337/327, 333, 337/372, 380, 379, 3, 85

[56] References Cited

U.S. PATENT DOCUMENTS 4,620,175 10/1986 Karr et al. ..... 337/343

FOREIGN PATENT DOCUMENTS

0315262A1 5/1989 European Pat. Off. .

0957044 5/1964 United Kingdom .

2115981 2/1982 United Kingdom .

*Primary Examiner*—Leo P. Picard

*Assistant Examiner*—Jayprakash N. Gandhi

*Attorney, Agent, or Firm*—Fish & Richardson P.C.

[57] ABSTRACT

A thermostat, having a seal structure, prevents contact of a resilient plate with an inner side of the housing, even if an extremely great current flows through the resislient plate. The thermostat has a bulging portion at an inner side of the housing to which the bimetal plate contacts, before the resilient plate contacts to an inner portion of the housing.

1 Claim, 4 Drawing Sheets

THERMOSTAT WITH BULGING PORTION TO PREVENT CONTACT OF A RESILIENT PLATE TO HOUSING

FIELD OF THE INVENTION AND RELATED ART STATEMENT

The present invention relates to a thermostat comprising: a fixed plate having a stable contact point, a resilient plate having a movable contact point, and a bimetal plate engaging with said resilient plate at its one end, whereby when temperature rises over a predetermined temperature, said bimetal plate deforms so as that said movable contact point separates from said stable contact point.

Such a thermostat is disclosed in Japanese patent application H-143239.

FIG. 6 is a cross section of a thermostat disclosed in it. FIG. 7 is a horizontal view of a bimetal plate of the thermostat. FIG. 8 is a horizontal view of a resilient plate of the thermostat. FIG. 9 is a horizontal view of a fixed plate of the thermostat.

A fixed plate 1 has a stable contact point 2. A resilient plate 3 has a movable contact point 4. The stable contact point 2 and the movable contact point 4 are so arranged that they contact to each other. One end 3*a* of said resilient plate 3 is folded, so that a bimetal plate 5 can engage with said resilient plate. Said resilient plate 3, said bimetal plate 5 and said fixed plate are fixed using a spacing member 6 and a fixing member 7. The assembly is disposed in a housing 8, the opening of the housing 9 is fulled with resin.

The electric current flows through said fixed plate 1, said stable contact point 2, said movable contact point 4 and said resilient plate 3 in this order. When temperature rises over a predetermined temperature, said bimetal plate deforms, so that said resilient plate deforms so as that said contact points separate from each other.

In general, the material for the housing 8 is selected from temperature resistive materials at the temperature that the bimetal plate functions and changes its form.

No problem occurs, when the environment temperature of the thermostat gradually rises over the predetermined temperature.

A thermostat can be used as a current breaker, to disconnect a power supply in case of a over-current. When over-current takes place, for example, a resilient plate heats itself by its electric resistance. This leads to temperature rising of the bimetal plate. And when the temperature rises over a predetermined temperature, the bimetal plate functions to deform the resilient plate. As a result, when an electric current passes over a predetermined value, the movable contact point separates from the stable contact point.

If the over-current is extremely great, there is a case, however, that the temperature of the resilient plate has already passed over the melting point of the material of the housing, when the temperature of the bimetal plate reaches to the predetermined temperature to deform its form. Because a thermostat has a sealed structure, its inner temperature tends to rise rapidly.

When a high temperature resilient plate contacts with the housing, the housing melts. And even after the solidification, the resilient plate can not separate from the inner side of the housing, as shown in FIGS. 10 and 11.

OBJECT AND SUMMARY OF THE INVENTION

An object of the present invention is to propose a thermostat, having a sealed structure, which can prevent the contact of a resilient plate with an inner side of the housing, even if an extremely great current flows though the resilient plate.

The purpose is solved by a thermostat comprising: a fixed plate having a stable contact point, a resilient plate having a movable contact point, and a bimetal plate engaging with said resilient plate at its one end, whereby when temperature rises over a predetermined temperature, said bimetal plate deforms so as that said movable contact point separates from said stable contact point, characterized in that the housing of the thermostat has a bulging portion at its inner side, to which said bimetal plate can contact, before said resilient plate contacts to an inner portion of said housing.

When an extremely great current flows through the resilient plate, the temperature of the resilient plate rapidly increases by its electric resistivity. The temperature of the bimetal plate increases by thermal conduction or heat radiation from the resilient plate. The bimetal plate deforms to contact with said bulging portion, before said resilient plate contacts with an inner portion of said housing. As a result, the resilient plate does not contact with an inner portion of said housing.

In general, at a bimetal plate functioning temperature, the material of the housing has a temperature resistivity. Thus, a thermostat can function normally, because the inner side of the housing has not softened at this temperature.

DETAILED DESCRIPTION OF PREFERRED EMBODIMENTS

Figure 1:
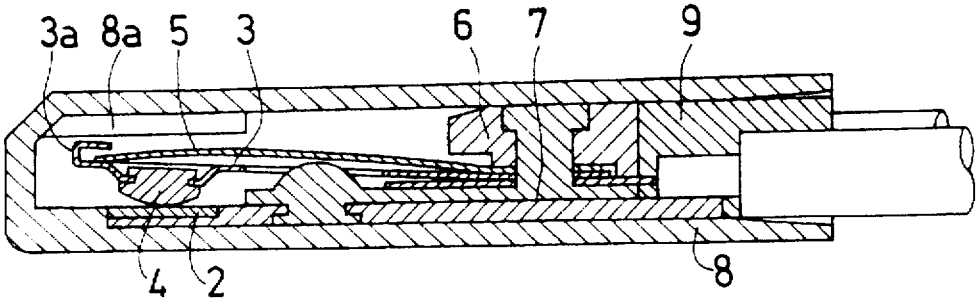
FIG. 1 shows a cross-section of a thermostat of the first embodiment of the present invention.

FIG. 1, 2, 3 show a first embodiment of the present invention. In these figures, the parts common with a thermostat of prior art in FIG. 6–11 have corresponding reference numerals, and the description for them is abbreviated.

In this embodiment, a bulgings 8*a*, rectangular in cross-section, are disposed at the upper corners of the inner side of the housing. The distance between the bulgings are wider than the width of the bimetal plate 5. The thickness of the bulgings 8*a* are at least 0.3 mm.

When bimetal plate 5 deforms and the resilient plate 3 moves towards an inner portion of the housing, (in FIG. 1, 2, 3, they bend itself upwardly), the bimetal plate 5 contacts with said bulgings 8*a*, before the resilient plate 3 contacts with an inner portion of said housing 8. In this moment, the movable contact point 4 separates from the stable contact point 2. As a result, the electric current stops, the heating ends, the temperature of the resilient plate 3 begins to decrease, and the thermostat continues to function normally.

Figure 2:
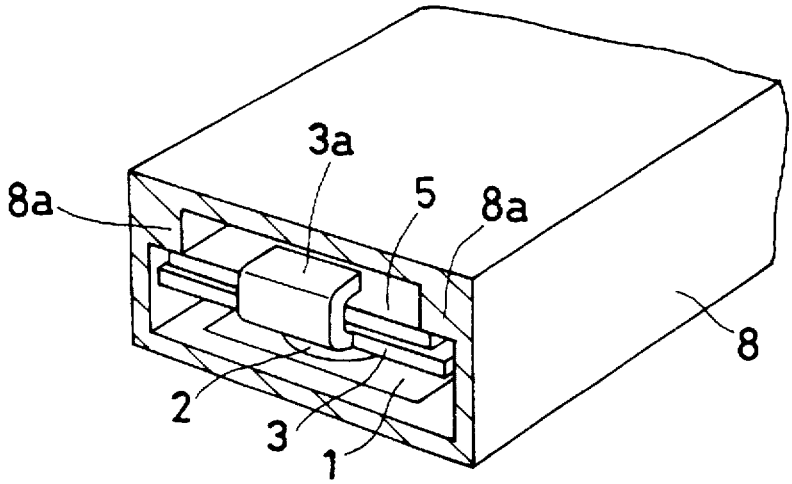
FIG. 2 shows a perspective view of the thermostat of FIG. 1, showing a cross-section cut at a position near to an engaging part of a resilient plate and a bimetal plate.
Figure 3:
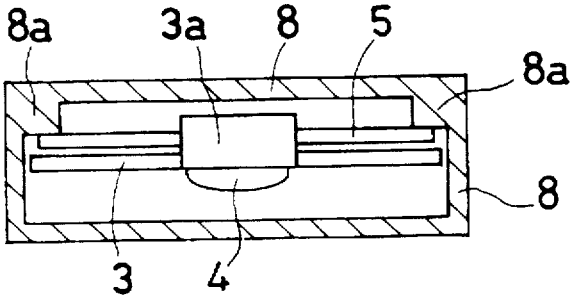
FIG. 3 shows a front view of the thermostat of FIG. 2.
Figure 4:
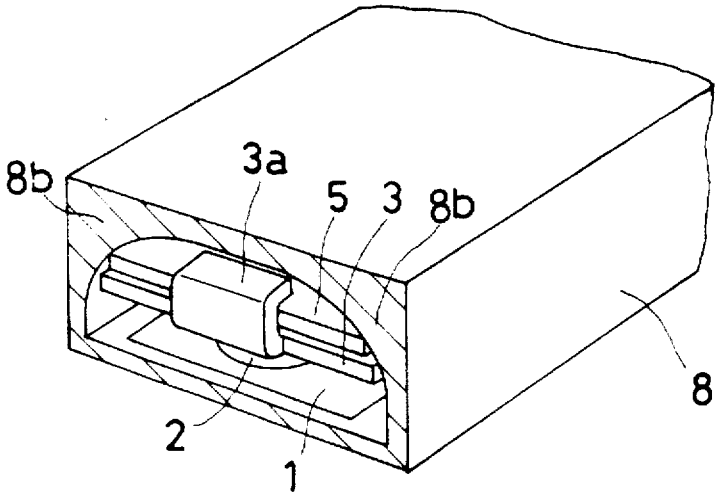
FIG. 4 shows a perspective view of a thermostat of the second embodiment, showing a cross-section cut at a position near to an engaging part of a resilient plate and a bimetal plate.
Figure 5:
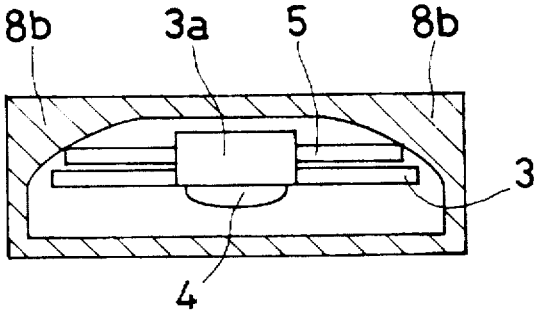
FIG. 5 shows a front view of the thermostat of FIG. 4.
Figure 6:
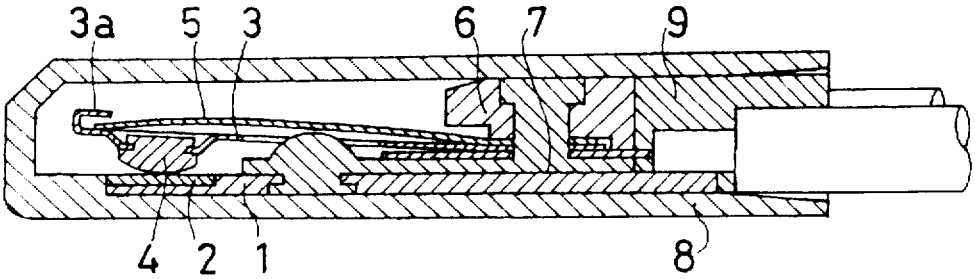
FIG.6 (PRIOR ART)
FIG. 6 shows a cross-section of a thermostat of prior art.
Figure 7:
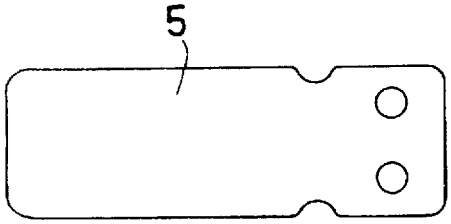
FIG.7 (PRIOR ART)
FIG. 7 shows a plan view of a bimetal plate of the thermostat of FIG. 6.
Figure 8:
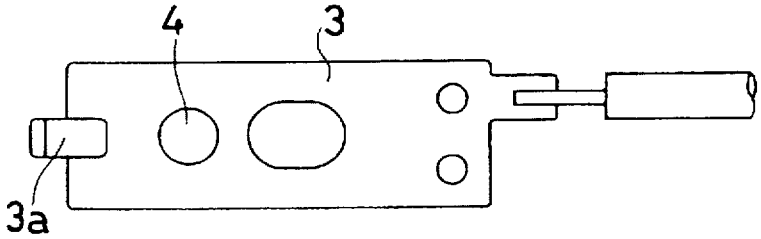
FIG.8 (PRIOR ART)
FIG. 8 shows a plan view of resilient plate of the thermostat of FIG. 6.
Figure 9:
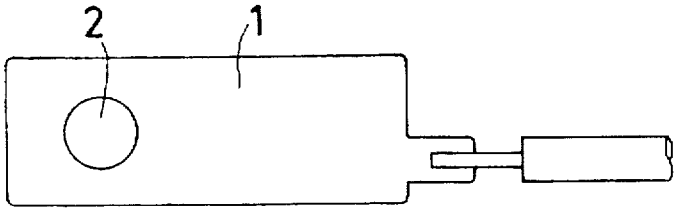
FIG.9 (PRIOR ART)
FIG. 9 shows a plan view of a fixed plate of the thermostat of FIG. 6.
Figure 10:
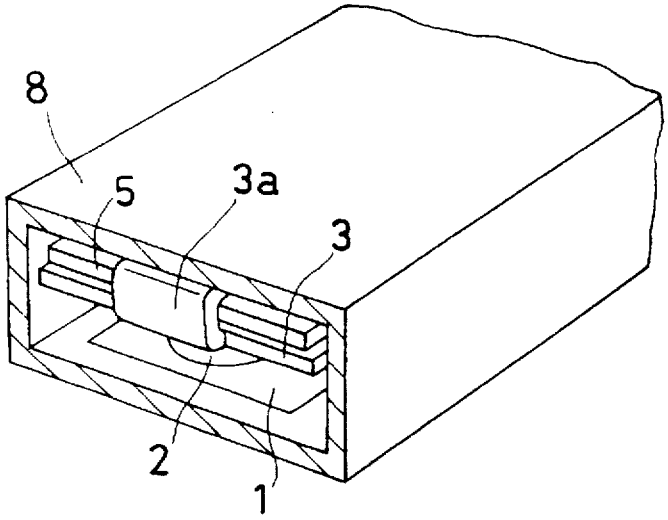
FIG.10 (PRIOR ART)
FIG. 10 shows a perspective view of a thermostat of FIG. 6, showing a cross-section cut at a position near to an engaging part of a resilient plate and a bimetal plate.
Figure 11:
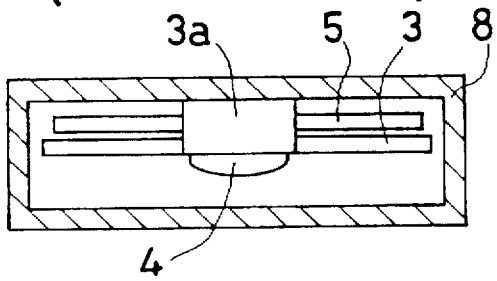
FIG.11 (PRIOR ART)
FIG. 11 shows a front view of the thermostat of FIG. 10.

FIG. 4 and 5 show another embodiment of the present invention. This embodiment differs from that of FIGS. 1, 2 in the form of the bulging at the inner side of the housing 8.

In this embodiment, the bulging portion is formed as an arch 8*b* where the wall is made thick; the corners of the inner side of the housing is not an angle, but a curve.

Also in this embodiment, when the bimetal plate 5 deforms and the resilient plate 5 moves towards an inner portion of the housing 8, (in FIGS. 1, 2 and, they bend upwardly), the bimetal plate 5 contacts with a portion of the arch 8*b*, before the resilient plate 3 contacts with the inner side up the housing 8. In this moment, the movable contact point 4 separates from the stable contact point 2 to stop the electric current flow. Consequently, the heating stops, and the temperature of the deformable plate 3 begins to decrease; the thermostat functions normally.

As an effect of the present invention, a thermostat according to the present invention functions surely even in case of extremely great electric current, because the resilient plate will never be fixed to an inner side of the housing.

I claim:

1. A thermostat having a cantilevered resilient plate comprising:

a fixed plate having a stable contact point;

a cantilevered resilient plate having a movable contact at a region near to its free end and a folded portion at its free end;

a bimetal plate hooked by said folded portion to engage with said resilient plate;

a housing made from a meltable material, said housing having an inner portion;

whereby when the temperature rises over a predetermined temperature, said bimetal plate deforms so that said movable contact separates from said stable contact point; and the housing having a bulging portion at its inner side, said bimetal plate arranged to contact said bulging portion before said resilient plate contacts an inner portion of said housing.

* * * * *